US006039491A

United States Patent [19]

Badillo

[11] Patent Number: 6,039,491

[45] Date of Patent: Mar. 21, 2000

[54] LIQUID SOAP APPLICATOR, AND METHOD

[76] Inventor: Connie M. Badillo, 2518 N. Shady Forest La., Orange, Calif. 92867

[21] Appl. No.: 09/131,216

[22] Filed: Aug. 7, 1998

[51] Int. Cl.[7] ..... B43M 11/06

[52] U.S. Cl. ..... 401/186; 401/185; 401/183

[58] Field of Search ..... 401/186, 185, 401/184, 183, 143, 146, 152

[56] References Cited

U.S. PATENT DOCUMENTS

| | | | |
|---|---|---|---|
| 3,345,673 | 10/1967 | Schwartzman | 401/183 |
| 4,850,729 | 7/1989 | Kramer et al. | 401/183 |
| 4,865,482 | 9/1989 | Van Landingham | 401/183 |
| 5,547,303 | 8/1996 | Pyrozyk | 401/186 |

*Primary Examiner*—David J. Walczak

[57] ABSTRACT

A soap applicator for use by both adults and children which can be actuated with only one hand while allowing the free hand to retain balance by adults in a shower, or to maintain equilibrium by children in a bathtub. The applicator comprises a deformable soap reservoir and a normally closed, removable, perforated connection means attached to a soap wash cloth. In the soap storage mode, soap will be retained in the reservoir without leakage onto the wash cloth, but when pressurized by a user, which requires the use of only one hand, soap will be forced from the reservoir into the perforated connection means and through the perforations onto the wash cloth. The connection means can function as a filling connection for the soap reservoir by disengaging from the reservoir, reversing the connection end into the reservoir and injecting soap into the filling end of the connection means.

2 Claims, 1 Drawing Sheet

LIQUID SOAP APPLICATOR, AND METHOD

BACKGROUND OF THE INVENTION

This invention relates to a new and improved liquid soap applicator and method for use both by adults and children using only one hand and thereby allowing the free hand of a user to maintain balance either in a shower or in a bathtub. The invention is of particular use by small children since they can become unbalanced in a bathtub, and even adults can lose their balance in a shower.

The soap applicator and method of this invention enables a user to apply liquid soap from a soap reservoir to a wash cloth using only one hand, thereby freeing one hand which can be used to balance the user. The applicator and method also enables the soap reservoir to be easily filled using connector components of the applicator.

THE INVENTION

According to the invention, a soap applicator and method of this invention comprises a deformable, liquid soap reservoir, a perforated wash cloth connector means, and a wash cloth attached to the connector means. When the reservoir is in a soap storage mode, and is not being deformed, liquid soap will be stored in the reservoir, without significant leakage into the connector means and attached wash cloth. However, during use, the reservoir is deformed using only one hand of a user, thereby forcing liquid soap into the connector means, through the perforations, and onto the wash cloth. This enables users to employ a free hand for maintaining their balance in a bathtub or shower.

DESCRIPTION OF THE PREFERRED EMBODIMENTS

Figure 1:
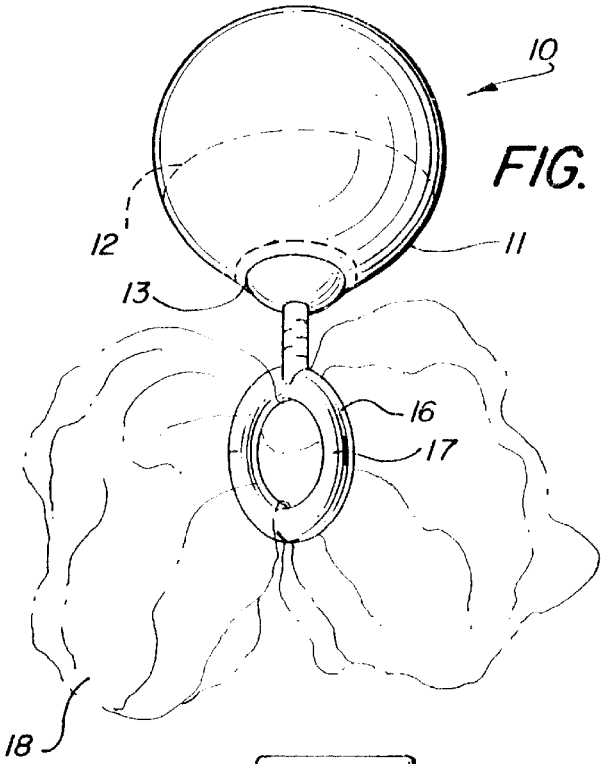
FIG. 1 is a perspective view of a liquid soap applicator of this invention.
Figure 2:
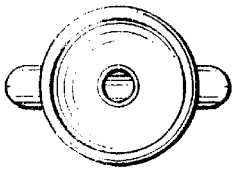
FIG. 2 is a top plan view of FIG. 1.
Figure 3:
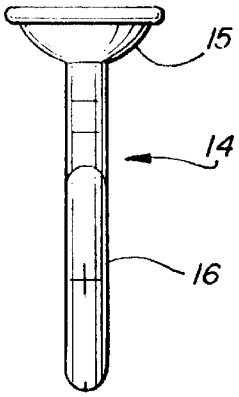
FIG. 3 is an external side elevation view of the connector means in a closed perforation mode.
Figure 4:
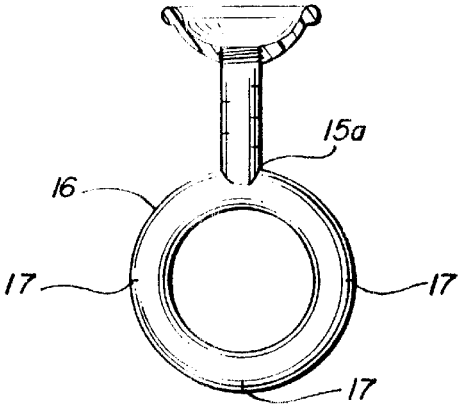
FIG. 4 is an external side elevation view of connector means showing the soap discharge manifold.
Figure 5:
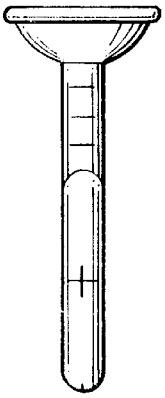
FIG. 5 is a external side elevation view of the connector means showing the discharge manifold partially disengaged from the connector; and, FIG. 6 is a bottom plan view of the connector means embodiment shown in FIG. 3.
Figure 6:
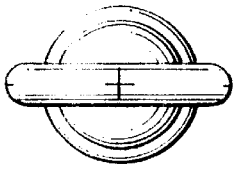

The liquid soap applicator 10 of this invention is shown in FIG. 1, and comprises a deformable, liquid soap reservoir 11 typically constructed of an elastic material such as rubber and which contains a liquid soap 12. The reservoir is shown as being spherically shaped, but can assume the various shapes of toys when the applicator is used by children.

The bottom of the reservoir provides an opening 13 into which is removably seated and sealed by a hollow connector valve 14 defining an oversized, flared-open filling end 15. The connector valve 14 defines a discharge end 15*a*, and a ring-shaped manifold 16 defining a plurality of perforations 17 is threadably connected into the discharge end 15*a*, as shown in FIGS. 3–6, or otherwise connected, such as by press fitting. A wash cloth 18 is attached to the manifold 16 by heat sealing, adhesives, sonic bonding, etc., and will absorb liquid soap which is forced out through the perforations 17.

In the normal soap storage mode of the reservoir 11, liquid soap 12 will be contained in the reservoir 11, and the perforations 17 of the manifold 16 will remain closed in the absence of pressure being applied to the reservoir; hence, soap will not escape from the reservoir, and will be stored therein.

However, when the reservoir is deformed simply by squeezing, for example with only one hand, liquid soap will be forced out of the reservoir 11 into the connector valve 14, through the perforations 17 of the manifold, and be captured for use by the wash cloth 18.

When the reservoir requires filling, the connector valve 14 is unseated from the reservoir opening 13, removed from the reservoir and unscrewed from the manifold. The discharge end 15*a* of the connector valve is then inserted into the reservoir, and liquid soap is squirted into the flared-open filling end 15 to fill the reservoir. When the reservoir is filled, the connector is then removed, and the filling end 15 is reinserted and resealed into the reservoir. Alternatively, the connector valve and manifold may be integrally formed, and the reservoir is filled by disconnecting the connector and attached manifold, and then filled from a conventional soap dispenser.

The device of this invention is simple and inexpensive, and it will be apparent that simple squeezing of the soap reservoir can be accomplished easily with only one hand. This enables adults, including elderly users to maintain their balance within the shower, or for young children or elderly individuals to better maintain their balance within a bathtub.

I claim:

1. A method for applying liquid soap from a deformable soap reservoir to a washing means with only one hand, thereby reducing the possibility of a user becoming unbalanced, the reservoir defining a sealable port, and a dispensing connector means defining a filling end, a discharge end, and a perforated, soap dispensing manifold removably connected to the discharge end, the filling end of the connector means being removably inserted into and sealing the sealable port of the reservoir; and, washing means attached to the soap dispensing manifold, the method comprising: A. storing liquid soap in the reservoir in the absence of pressure being applied thereto, the reservoir being adapted for application of pressure with only one hand, pressurizing soap through the sealable port, and through the perforations in the manifold for capture by the washing means; and, B. filling the reservoir by disengaging the connector from the reservoir and disconnecting the connector from the manifold, inserting the discharge end of the connector into the reservoir, and supplying soap through the filling end of the connector and through the discharge end into the reservoir.

2. The method of claim 1, in which the reservoir is filled by disengaging the connector from the reservoir and filling the reservoir from a liquid soap dispenser.

* * * * *